US008009009B2

(12) United States Patent
Zhang et al.

(10) Patent No.: US 8,009,009 B2
(45) Date of Patent: Aug. 30, 2011

(54) COIL MODULE

(75) Inventors: Han Zhang, Dong-Guan (CN); Zhi Huang, Dong-Guan (CN); Wei Chen, Dong-Guan (CN); Johnson Li, Dong-Guan (CN); C. S. Kung, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/643,379

(22) Filed: Dec. 21, 2009

(65) Prior Publication Data

US 2010/0321146 A1 Dec. 23, 2010

(30) Foreign Application Priority Data

Jun. 19, 2009 (TW) ..... 98120594 A

(51) Int. Cl.

| | |
|---|---|
| ***H01F 27/28*** | (2006.01) |
| ***H01F 27/24*** | (2006.01) |
| ***H01F 17/04*** | (2006.01) |
| ***H01F 7/06*** | (2006.01) |

(52) U.S. Cl. ..... 336/229; 336/213; 336/221; 336/222; 29/605

(58) Field of Classification Search ..... None
See application file for complete search history.

(56) References Cited

U.S. PATENT DOCUMENTS

| | | | | |
|---|---|---|---|---|
| 3,214,912 | A * | 11/1965 | Gabriel et al. | 60/340 |
| 3,448,421 | A * | 6/1969 | Berg | 336/84 R |
| 3,665,597 | A * | 5/1972 | Tan et al. | 29/605 |
| 6,879,237 | B1 * | 4/2005 | Viarouge et al. | 336/229 |
| 7,154,368 | B2 * | 12/2006 | Sweeney et al. | 336/229 |
| 2004/0172806 | A1 * | 9/2004 | Yoshimori | 29/605 |
| 2009/0051478 | A1 * | 2/2009 | Lee et al. | 336/212 |

* cited by examiner

*Primary Examiner* — Anh T Mai
*Assistant Examiner* — Mangtin Lian
(74) *Attorney, Agent, or Firm* — Patterson Thuente Christensen Pedersen P.A.

(57) ABSTRACT

A coil module comprises a circular core and a winding is provided. The circular core comprises an outer circular portion and an inner circular portion. The winding is wound around the outer circular portion in a single-layer configuration and around the inner circular portion in a multi-layer configuration. The coil module comprises a first thickness after the winding is wound around the outer circular portion and comprises a second thickness after the winding is wound around the inner circular portion, wherein the first thickness is greater than or equal to the second thickness.

18 Claims, 4 Drawing Sheets

COIL MODULE

This application claims the benefit from the priority of Taiwan Patent Application No. 098120594 filed on Jun. 19, 2009, the disclosures of which are incorporated by reference herein in their entirety.

CROSS-REFERENCES TO RELATED APPLICATIONS

Not applicable.

BACKGROUND OF THE INVENTION

1. Field of the Invention

The present invention provides a coil module with a thin-profile design.

2. Descriptions of the Related Art

As passive electronic components, coil modules have been widely used in various electronic products to provide the filtering, energy storage, energy releasing and functions of the like, by converting electric energy into magnetic energy or vice versa, thereby, stabilizing the output current. In conventional technologies, a coil module (not shown) comprises a circular core 10 as shown in FIG. 1 (a cross-sectional view of the circular core 10 is shown in FIG. 1) and at least one winding (not shown) wound around the circular core 10. The circular core 10 of the conventional coil module typically has a rectangular cross-section 13, so that the inner circular portion 12 and outer circular portion 11 of the circular core 10 have the same height H0. Because an outer perimeter corresponding to the outer circular portion 11 is greater than the inner perimeter corresponding to the inner circular portion 12, the winding density in the inner circular portion 12 of the circular core 10 is greater than that in the outer circular portion 11 of the circular core 10 when the winding is wound around the circular core 10. As the turn number of the winding wound around the circular core 10 increases, the winding density in the inner circular portion 12 of the circular core 10 will become more compact, and possibly result in a plurality of winding layers in the inner circular portion 12 of the circular core 10. The increase in winding layers causes an increase in the height corresponding to the inner circular portion 12 of the coil module. This is especially true when the winding has a large wire thickness and the difference between the outer perimeter and the inner perimeter is excessively large.

Because most electronic products today are evolving towards a lightweight, thin-profile, and miniaturized design, conventional coil modules can no longer satisfy this demand. An increase in the height corresponding to the inner circular portion 12 of such a coil module would have a significant adverse influence on the overall volume of the coil module, making it impossible to install such a conventional coil module in miniaturized and thin-profile electronic products.

In view of this, efforts still have to be made to provide a coil module with a thin-profile design adapted to effectively reduce the overall volume of the coil module so that the coil module may be used in various miniaturized electronic products.

SUMMARY OF THE INVENTION

One objective of the present invention is to provide a coil module with a thin-profile design, which is adapted to reduce the overall volume of the coil module so that the coil module may be used in a miniaturized and thin-profile electronic product.

The coil module disclosed in the present invention comprises a circular core and a winding. The circular core has an outer circular portion and an inner circular portion, and the winding is wound around the circular core. The winding is wound around the outer circular portion in a single-layer configuration and around the inner circular portion in a multi-layer configuration. The outer circular portion and the inner circular portion of the circular core have a first height and a second height respectively, with the first height greater than the second height.

In another embodiment of the present invention, the coil module comprises a circular core and a winding. The circular core has an outer circular portion and an inner circular portion. The winding is wound around the circular core. The winding is wound around the outer circular portion in a single-layer configuration and around the inner circular portion in a multi-layer configuration. The coil module has a first thickness after the winding is wound around the outer circular portion. The coil module has a second thickness after the winding is wound around the inner circular portion, in which the first thickness is greater than or equal to the second thickness.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
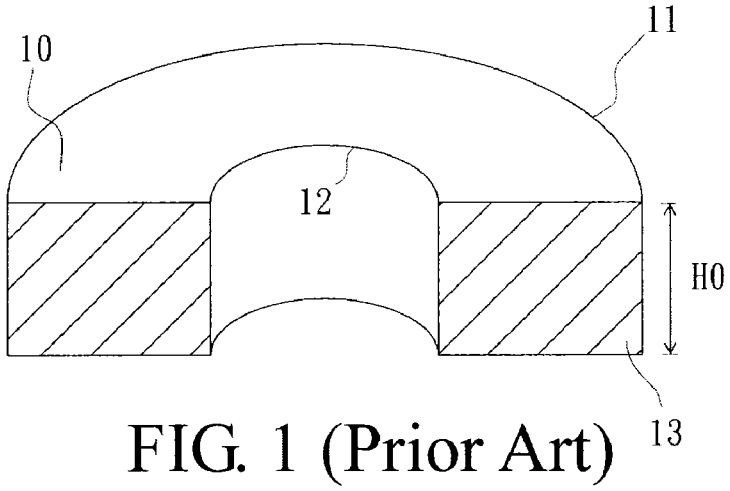
FIG. 1 (Prior Art)
FIG. 1 is a schematic cross-sectional view of a conventional circular core.
Figure 2:
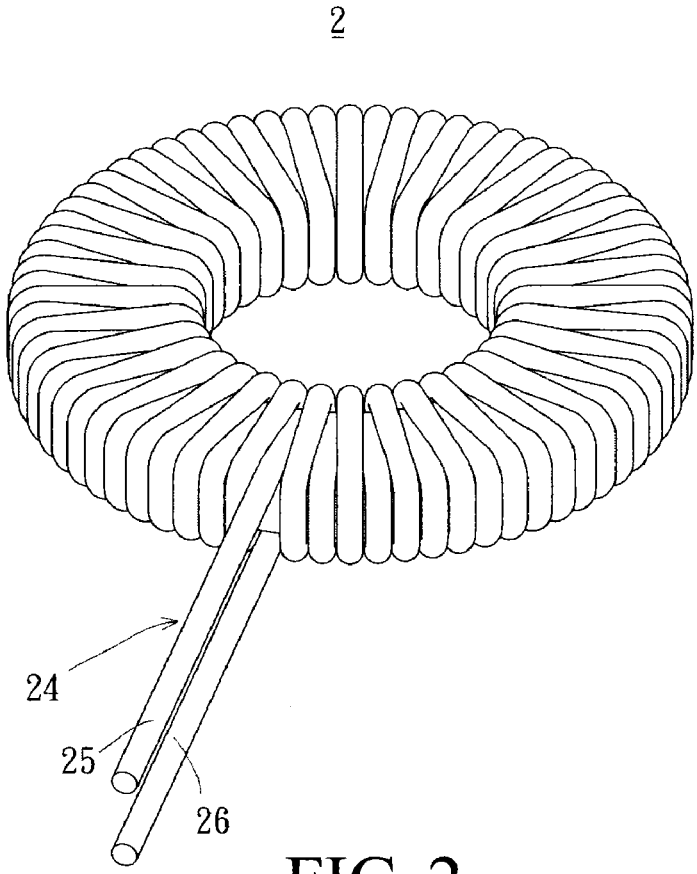
FIG. 2 is a perspective view of a coil module of the present invention.
Figure 3A:
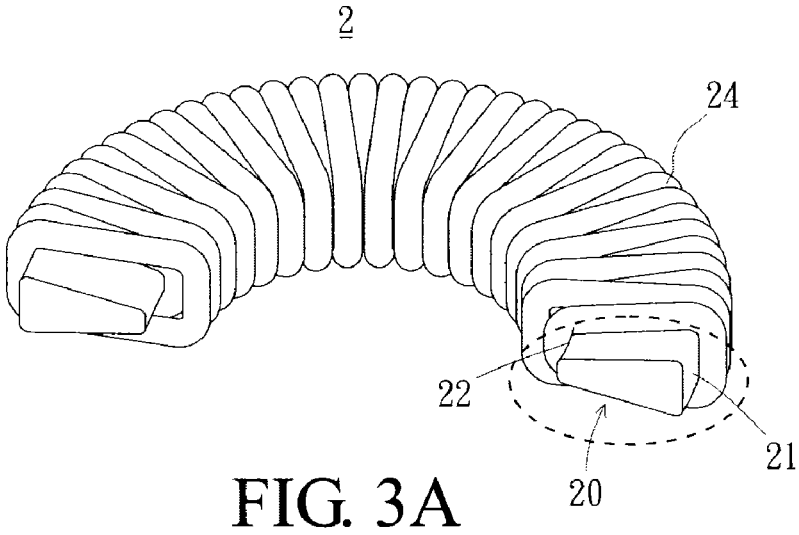
FIG. 3A is a schematic cross-sectional perspective view of the coil module shown in FIG. 2.
Figure 3B:
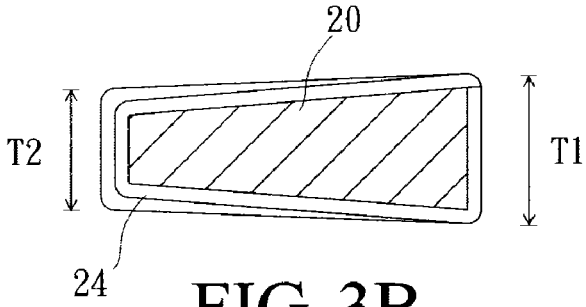
FIG. 3B is a partially enlarged schematic view of a portion encircled by the dashed line shown in FIG. 3A.

FIGS. 2, 3A and 3B show an embodiment of a coil module 2 of the present invention. FIG. 3A is a cross-sectional perspective view of the coil module shown in FIG. 2, and FIG. 3B is a partially enlarged schematic view of a portion encircled by the dashed line shown in FIG. 3A. The coil module 2 comprises a circular core 20 and a winding 24. The circular core 20 has an outer circular portion 21 and an inner circular portion 22, and the winding 24 is wound around the circular core 20. Specifically, the winding 24 is wound around the outer circular portion 21 of the circular core 20 in a single-layer configuration and around the inner circular portion 22 of the circular core 20 in a multi-layer configuration. The turns of the winding 24 wound around the outer circular portion 21 in the single-layer configuration are adjacent to each other, while the turns of the winding 24 wound around the inner circular portion 22 in the multi-layer configuration are stacked with each other. Hence, as shown in FIG. 3B, after the winding 24 is wound around the outer circular portion 21 and the inner circular portion 22 of the circular core 20, the coil module 2 has a first thickness T1 corresponding to the outer circular portion 21 and a second thickness T2 corresponding to the inner circular portion 22 respectively, in which the first thickness T1 is greater than or equal to the second thickness T2.

Figure 4:
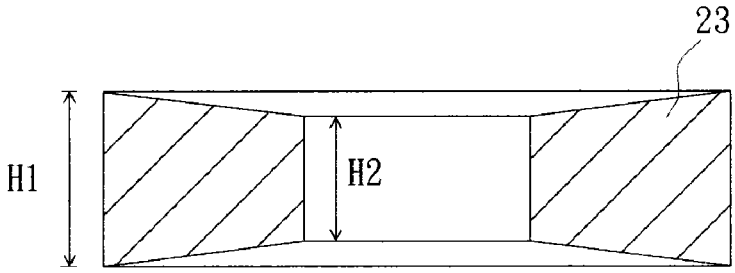
FIG. 4 is a cross-sectional view of a circular core of the coil module shown in FIG. 2.

FIG. 4 illustrates a cross-sectional view of the circular core 20 shown in FIG. 3A. The circular core 20 has a trapezoidal cross-section 23. In this embodiment, the outer circular portion 21 and the inner circular portion 22 of the circular core 20 have a first height H1 and a second height H2 respectively, in which the first height H1 is greater than the second height H2. Additionally, in this embodiment, as shown in FIGS. 2 and 3A, a single winding 24 is wound around the circular core 20, and a difference of the layer number ΔL between the outer circular portion 21 and the inner circular portion 22 is one layer. That is, the winding 24 is wound around the outer circular portion 21 in a single-layer configuration and around the inner circular portion 22 in a dual-layer configuration.

In practice, as shown in FIGS. 2, 3A and 3B and beginning from a first end 25, the winding 24 passes through the outer circular portion 21 of the circular core 20, then passes through the central portion of the circular core 20 along the inner circular portion 22. From the inner circular portion 22, the winding 24 passes through the outer circular portion 21 again to complete a turn around the circular core 20. Subsequently, adjacent to the previous turn and from the outer circular portion 21, the winding 24 is again wound along the inner circular portion 22 but stacked with the previous turn, and then passes through the central portion of the circular core 20. After that, from the inner circular portion 22, the winding 24 passes through the outer circular portion 21 again to complete another turn around the circular core 20. By repeating the above steps, the winding 24 is wound around the outer circular portion 21 with turns adjacent to each other, and wound around the inner circular portion 22 with turns being stacked with each other, thereby completing the winding 24 being wound around the circular core 20. Then, by applying a current through the first end 25 and a second end 26, an electromagnetic induction effect can be generated across the coil module 2.

The above embodiment will be described in detail hereinbelow. To have the circular core 20 of the present invention comply with the aforesaid requirements, the circular core 20 must further satisfy the relationship of $(H1-H2)/2 \geqq \Delta L \times \Phi$, where Φ is the wire diameter of the winding 24. This ensures that the second thickness T2 of the coil module 2 after the winding 24 is wound around the inner circular portion 22 in a multi-layer configuration is no greater than the first thickness T1 of the coil module 2 after the winding 24 is wound around the outer circular portion 21 in a single-layer configuration. That is, the maximum thickness of the coil module 2 will not be increased due to the increase in the number of layers of the winding 24 around the inner circular portion 22. In practice, it should be readily appreciated that if the difference between the first height H1 and the second height H2 is a constant value, then the thinner the wire of the winding 24 (i.e., the smaller the diameter Φ), the greater the difference of the layer number ΔL between the outer circular portion 21 and the inner circular portion 22. Conversely, the thicker the wire of the winding 24 (i.e., the larger the diameter Φ), the smaller the difference of the layer number ΔL between the outer circular portion 21 and the inner circular portion 22.

Secondly, the circular core 20 has an outer perimeter corresponding to the outer circular portion 21, the single layer wound around the outer circular portion 21 has a first turn number, and the outer perimeter is greater than the product of the first turn number and the wire diameter Φ. This ensures that the winding 24 can be wound around the outer circular portion 21 in a single-layer configuration without resulting in a multi-layer configuration.

Furthermore, the circular core 20 has an inner perimeter corresponding to the inner circular portion 22, and the two winding layers wound around the inner circular portion 22 have a second turn number (which is a half of the first turn number in this embodiment) respectively. The inner perimeter is greater than the product of the second turn number and the wire diameter Φ. Thus, each winding layer around the inner circular portion 22 has the second turn number. Hence, by controlling the parameters described above, the coil modules 2 that comply with different requirements and have the first thickness T1 greater than or equal to the second thickness T2 can be designed depending on practical conditions.

Figure 5:
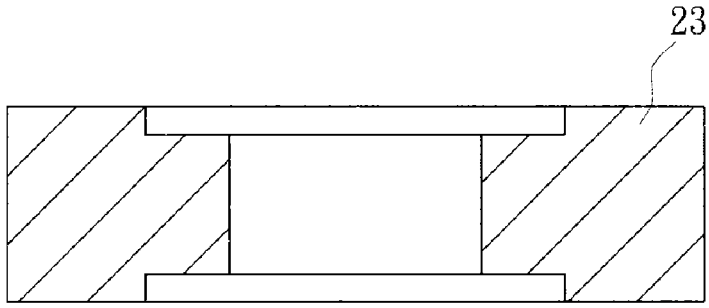
FIGS. 5, 6 and 7 are cross-sectional views of a circular core in other embodiments of the present invention.
Figure 6:
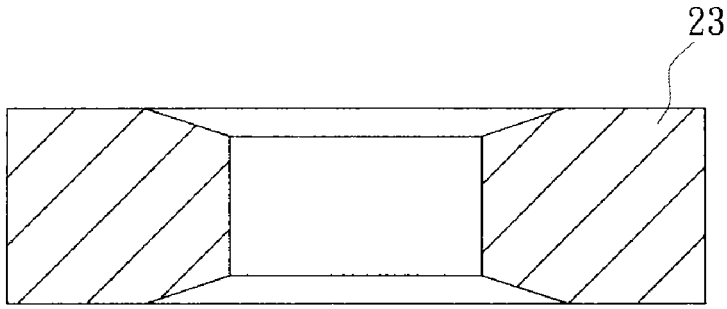
Figure 7:
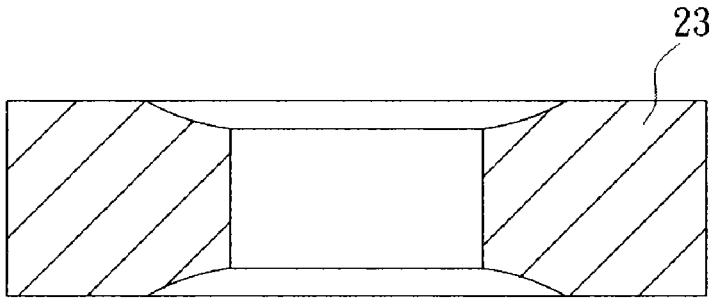

In other examples of the present invention, the circular core 20 may also have a stepped cross-section as shown in FIG. 5. However, the present invention is not limited thereto, and the cross-section may also be as shown in FIGS. 6 and 7. Other shapes of the cross-section enabling the coil module 2 to have the first thickness T1 greater than or equal to the second thickness T2 will readily occur to those of ordinary skill in the art. Meanwhile, although the circular core 20 itself is of a circular form in this embodiment, it may also be of an elliptical form or a polygonal form in other embodiments, and the present invention is not limited thereto.

Figure 8:
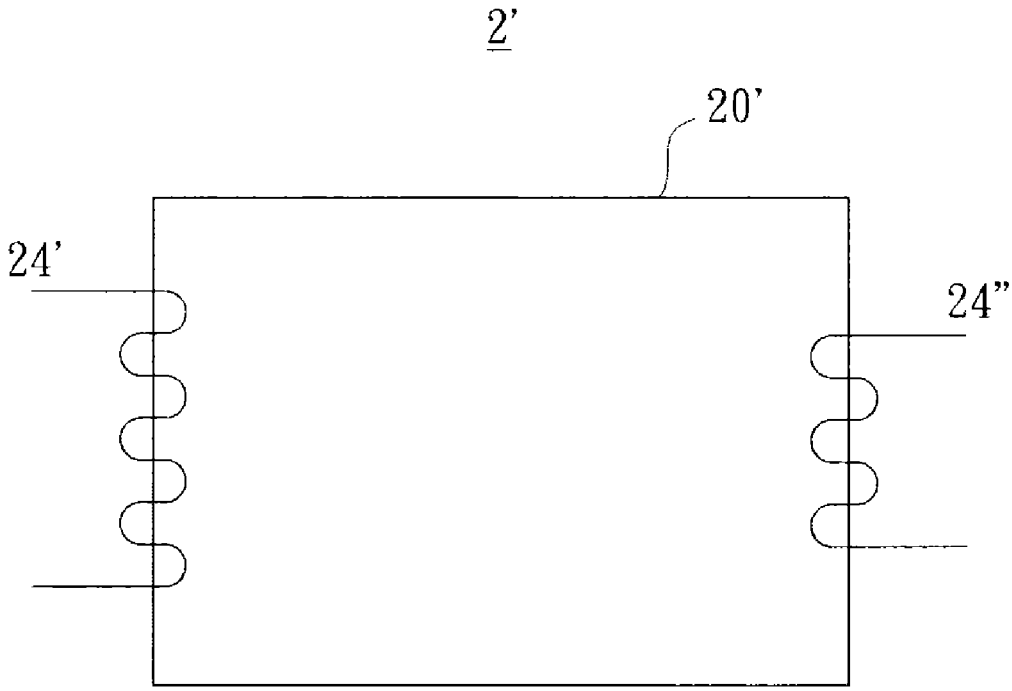
FIG. 8 is a schematic view of a coil module of the present invention that has two windings.

It should be noted that in the above embodiment, only a single winding 24 is wound around the circular core 20 with the difference of the layer number ΔL is one layer. However, in other embodiments, as shown in FIG. 8, there may be more than one winding (e.g., 24', 24") wound around the circular core 20' of the coil module 2' respectively, and the difference of the layer number ΔL may be greater than one layer. Additionally, as shown in FIGS. 4 to 7, the cross-section 23 of the circular core 20 has a shape that is symmetrical in the vertical direction; however, the present invention is not limited thereto, and the shape of the cross-section 23 may also be unsymmetrical so long as the first thickness T1 of the coil module 2 is greater than or equal to the second thickness T2.

According to the above descriptions, by winding the winding around the outer circular portion and the inner circular portion of the circular core respectively and making the first height of the outer circular portion greater than the second height of the inner circular portion, the first thickness of the coil module is made to be greater than or equal to the second thickness after the winding is wound around the circular core. Thereby, the coil module can have its volume effectively reduced to be used in miniaturized and thin-profile electronic products, thereby effectively reducing the overall volume of the electronic products.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A coil module comprising:

a circular core with a closed shape comprising an outer circular portion and an inner circular portion; and a winding being wound around the circular core, in which the winding is wound around the outer circular portion in a single-layer configuration, and the winding is wound around the inner circular portion in a multi-layer configuration;

wherein the circular core is in compliance with a relationship of: $(H1-H2)/2 \geqq \Delta L \times \Phi$, in which H1 is a first height, H2 is a second height, the first height being greater than the second height, $\Delta L$ is a difference of the layer number of the winding wound around the outer circular portion and the inner circular portion, and $\Phi$ is a wire diameter of the winding.

2. The coil module as claimed in claim 1, wherein the coil module has a first thickness after the winding being wound around the outer circular portion, and the coil module has a second thickness after the winding being wound around the inner circular portion, in which the first thickness is greater than or equal to the second thickness.

3. The coil module as claimed in claim 1, wherein the circular core has an outer perimeter, and the winding wound around the outer circular portion in the configuration of the single-layer has a first turn number, in which the perimeter of the outer diameter is greater than the product of the first turn number and the diameter of the winding.

4. The coil module as claimed in claim 3, wherein the circular core has an inner perimeter, and each layer of the winding wound around the inner circular portion in the configuration of the multi-layers has a second turn number, in which the perimeter of the inner diameter is greater than the product of the second turn number and the diameter of the winding.

5. The coil module as claimed in claim 1, wherein the circular core has a cross-section formed of trapezoid.

6. The coil module as claimed in claim 1, wherein the circular core has a cross-section formed of stepped shape.

7. The coil module as claimed in claim 1, wherein the turns of the winding wound around the outer circular portion in the single-layer configuration are adjacent to each other, and turns of the winding wound around the inner circular portion in the multi-layer configuration are stacked with each other.

8. The coil module as claimed in claim 1, wherein a shape of the circular core is formed of a group consisting of a circle, an ellipse and a polygon.

9. The coil module as claimed in claim 2, further comprising a plurality of windings wound around the circular core respectively.

10. A coil module comprising:

a circular core with a closed shape comprising an outer circular portion and an inner circular portion; and a winding being wound around the circular core, in which the winding is wound around the outer circular portion in a single-layer configuration, and the winding is wound around the inner circular portion in a multi-layer configurations;

wherein the coil module has a first thickness after the winding being wound around the outer circular portion, the coil module has a second thickness after the winding being wound around the inner circular portion, the first thickness being greater than or equal to the second thickness, and the circular core is in compliance with a relationship of: $(H1-H2)/2 \geqq \Delta L \times \Phi$, in which H1 is a first height, H2 is a second height, $\Delta L$ is the difference of a layer number of the winding wound around the outer circular portion and the inner circular portion, and $\Phi$ is a diameter of the winding.

11. The coil module as claimed in claim 10, wherein the first height is greater than the second height.

12. The coil module as claimed in claim 10, wherein the circular core has an outer perimeter, and the winding wound around the outer circular portion in the configuration of the single-layer has a first turn number, in which the perimeter of the outer diameter is greater than the product of the first turn number and the diameter of the winding.

13. The coil module as claimed in claim 12, wherein the circular core has an inner perimeter, and each layer of the winding wound around the inner circular portion in the configuration of multi-layers has a second turn number, in which the perimeter of the inner diameter is greater than the product of the second turn number and the diameter of the winding.

14. The coil module as claimed in claim 11, wherein the circular core has a cross-section formed of trapezoid.

15. The coil module as claimed in claim 11, wherein the circular core has a cross-section formed of stepped shape.

16. The coil module as claimed in claim 10, wherein the winding wound around the outer circular portion in the configuration of single-layer are adjacent to each other, and the winding wound around the inner circular portion in the configuration of multi-layers are stacked with each other.

17. The coil module as claimed in claim 10, wherein a shape of the circular core is formed of a group consisting of a circle, an ellipse and a polygon.

18. The coil module as claimed in claim 10, further comprising a plurality of windings wound around the circular core respectively.

* * * * *